US007628595B2

(12) United States Patent
Ono et al.

(10) Patent No.: US 7,628,595 B2
(45) Date of Patent: Dec. 8, 2009

(54) GAS VANE PUMP, AND METHOD OF OPERATING THE PUMP

(75) Inventors: Kohei Ono, Nagoya (JP); Hiroyuki Ikemoto, Nishikamo-gun (JP); Junichi Tanoue, Susono (JP); Ulrich Hiltemann, Wermelskirchen (DE); Christoph Heidemeyer, Remscheid (DE)

(73) Assignees: Toyota Jidosha Kabushiki Kaisha, Toyota (JP); Luk Automobiltechnik GmbH & Co. KG, Huckeswagen (DE)

( * ) Notice: Subject to any disclaimer, the term of this patent is extended or adjusted under 35 U.S.C. 154(b) by 469 days.

(21) Appl. No.: 10/591,034

(22) PCT Filed: Mar. 8, 2005

(86) PCT No.: PCT/JP2005/004411

§ 371 (c)(1),
(2), (4) Date: Oct. 18, 2006

(87) PCT Pub. No.: WO2005/085645

PCT Pub. Date: Sep. 15, 2005

(65) Prior Publication Data

US 2008/0240962 A1 Oct. 2, 2008

(30) Foreign Application Priority Data

Mar. 10, 2004 (JP) ..... 2004-067849

(51) Int. Cl.
*F03C 2/00* (2006.01)
*F03C 4/00* (2006.01)
*F04C 18/00* (2006.01)

(52) U.S. Cl. ..... 418/255; 418/93; 418/94; 418/99; 418/100

(58) Field of Classification Search ..... 418/93, 418/94, 96–100, 106, 253–255, 259, 266–268
See application file for complete search history.

(56) References Cited

U.S. PATENT DOCUMENTS 2,305,317 A * 12/1942 Nickell ..... 418/93
3,499,600 A * 3/1970 McGregor ..... 418/94

(Continued)

FOREIGN PATENT DOCUMENTS

JP A 58-8289 1/1983

(Continued)

*Primary Examiner*—Theresa Trieu
(74) *Attorney, Agent, or Firm*—Oliff & Berridge, PLC

(57) ABSTRACT

A gas vane pump wherein a lubricant is intermittently introduced into a housing during rotation of a rotor, through a supply passage formed through the housing and the rotor, and the relative position between the rotor having a diametric hole and the housing having a communication groove is determined such that when the rotor is at an angular position in the middle of a predetermined angular range relative to the housing and the hole is in communication with the groove, a point of contact between a vane movably held by the rotor and the inner circumferential surface of the housing is located at the lowest position of the inner circumferential surface. When the rotor is stopped within the predetermined angular range, the vane divides the remaining lubricant into two portions, which are discharged at different times, making it possible to reduce the load on the vane upon restarting the pump.

16 Claims, 4 Drawing Sheets

U.S. PATENT DOCUMENTS 3,877,851 A * 4/1975 Komiya et al. ..... 418/88

FOREIGN PATENT DOCUMENTS

JP 60060288 A * 4/1985 ..... 418/93

JP U 3-1294 1/1991

JP A 3-115792 5/1991

JP A 7-189971 7/1995

* cited by examiner

GAS VANE PUMP, AND METHOD OF OPERATING THE PUMP

TECHNICAL FIELD

The present invention relates in general to a gas vane pump of a type in which a lubricant is intermittently introduced into a housing as a rotor is rotated, and a method of operating the gas vane pump. More particularly, this invention is concerned with techniques for reducing a load which acts on a vane and other elements of the vane pump due to the lubricant remaining within the housing when a rotary motion of the rotor once stopped is resumed.

BACKGROUND ART

A vane pump is known as one of gas pumps such as a vacuum pump and a compressor, which are arranged to suck and deliver a gas. The vane pump includes a housing, a rotor and at least one vane, which cooperate to define a plurality of variable-volume chambers. The volume of each variable-volume chamber is increased and decreased during rotation of the rotor, to thereby suck and deliver the gas. The gas vane pump may be of an intermittent lubrication type wherein a lubricant for lubricating sliding portions of the housing, rotor and vane(s) is intermittently introduced into the housing as the rotor is rotated. JP-3-115792A discloses a gas vane pump equipped with a metering device arranged to introduce a metered amount of lubricant into the housing per each revolution of the rotor, for preventing an excessively large amount of supply of the lubricant into the housing. This metering device also functions to prevent an unnecessary supply of the lubricant into the housing after termination of the rotary motion of the rotor.

DISCLOSURE OF THE INVENTION

However, the provision of the metering device indicated above undesirably increases structural complexity of the gas vane pump of the intermittent lubrication type, and results in an increase in the cost of manufacture of the gas vane pump. It is therefore an object of the present invention to minimize a load which acts on at least one vane and other elements of the gas vane pump due to a lubricant remaining within the housing when a rotary motion of the rotor once stopped is resumed.

The first object indicated above may be achieved according to a first aspect of this invention, which provides a method of operating a gas vane pump including (a) a housing, (b) a rotor rotatably disposed within the housing and cooperating with the housing to define a pump chamber having a dimension in a radial direction of the rotor, which dimension varies in a rotating direction of the rotor, (c) at least one vane portion held by the rotor movably relative to the rotor and dividing the pump chamber into a plurality of variable-volume chambers, and (d) a lubricant supply passage formed through the housing and the rotor, the lubricant supply passage being closed when the rotor is placed at an angular position relative to the housing, which angular position is outside a predetermined angular range, and opened for communication with an external lubricant supply source when the rotor is placed at an angular position within the predetermined angular range, the method being characterized in that the vane pump is operated so as to satisfy a condition that when the rotor is stopped at an angular position relative to the housing, which angular position is within the predetermined angular range, a mass of a lubricant remaining in a lowest portion of the pump chamber is divided into a first portion and a second portion, by an initial divider vane which is provided by one of the at least one vane portion.

In the method of operating the gas vane pump according to the present invention, the lubricant supply passage is closed when the rotor is stopped at an angular position outside the predetermined angular range. Accordingly, the lubricant supply passage prevents an excessively large amount of supply of the lubricant into the housing when the rotor is stopped at the angular position outside the predetermined angular range. When the rotor is stopped at an angular position within the predetermined angular range, that is, when the vane pump is turned off with the lubricant supply passage being in the open state, the amount of supply of the lubricant into the housing is almost the same as in the known vane pump. Where the gas vane pump is used as a vacuum pump, the interior space (pump chamber) of the housing is kept at a reduced or negative pressure when the rotor is kept at rest, so that the lubricant is drawn or sucked into the housing due to the reduced pressure. Where the gas vane pump is used as a compressor, the variable-volume chamber on the suction side may be kept at a reduced pressure while the compressor is at rest. In this case, too, the lubricant is introduced into the housing when the compressor is turned off. Where a pressurized lubricant delivered from an external lubricant supply source is introduced into the housing, the pressurized lubricant is introduced into the housing upon stopping of the gas vane pump, irrespective of whether the vane pump is used as the vacuum pump or the compressor.

The lubricant mass introduced into the housing is accommodated in the lowest portion of the pump chamber, due to the gravity, as in the known vane pump. In the present method, the lubricant mass remaining in the lowest portion of the pump chamber is divided into the first and second portions by the initial divider vane located at a position adjacent to the lowest point of the pump chamber, when the angular position at which the rotor is stopped is within the predetermined angular range relative to the housing. When the rotation of the rotor is subsequently resumed, the first portion of the lubricant mass is discharged by the initial divider vane, and then the second portion of the lubricant mass is discharged by a subsequent vane which follows the initial divider vane.

It will be understood that whether the lubricant mass remaining in the lowest portion of the pump chamber within the housing is divided by the first and second portions by the initial divider vane located adjacent to the lowest point of the pump chamber depends largely upon the position at which the initial divider vane is stopped. Where the point of contact of the initial divider vane with the inner circumferential surface of the housing is located at the lowest point of the pump chamber (of the inner circumferential surface), for example, the lubricant mass is theoretically divided by the initial divider vane into two portions having substantially the same volume, irrespective of the volume of the lubricant mass. Described more precisely, these two portions have substantially the same volume, if an inclination of the initial divider vane with respect to the vertical and asymmetry of the shape of the pump chamber with respect to a vertical plane passing the lowest point of the pump chamber are ignored. Described in a simple way, therefore it is desirable that the point of contact between the initial divider vane and the inner circumferential surface of the housing be located at the lowest point of the pump chamber when the angular position at which the rotor is stopped is in the middle of the predetermined angular range.

Actually, however, a certain amount of the first portion of the lubricant mass adheres to the inner circumferential surface of the housing and the side surfaces of the vane(s) as the first portion is transferred by the initial divider vane from the lowest portion of the pump chamber to a discharging portion of the housing. During an operation of the gas vane pump, the above-indicated inner circumferential surface and side surfaces are covered by films of the lubricant. Where the vane pump is kept at rest for a relatively long time, the lubricant which adhered to the above-indicated surfaces during the operation of the vane pump flows down into the lowest portion of the pump chamber, and those surfaces are substantially dry, with substantially no amount of the lubricant covering those surfaces. Accordingly, the first portion of the lubricant tends to easily adhere to those surfaces while the first portion is moved by the initial divider vane from the lowest portion to the discharging portion of the housing. When the second portion of the lubricant mass is discharged, on the other hand the above-indicated surfaces have already been covered with the films of the lubricant, so that an almost entire amount of the second portion is discharged. In this respect, the volume of the first portion is preferably made slightly larger than that of the second portion.

It is also noted that the rotating speed of the rotor immediately after the gas vane pump is started is generally lower than that during a subsequent operation of the gas vane pump in a steady state, although the initial rotating speed varies depending upon the type of the drive device of the vane pump. Accordingly, the rate of discharge flow of the first portion of the lubricant mass is lower than that of the second portion, so that a load acting on the initial divider vane during discharging of the first portion is smaller than a load acting on the subsequent vane during discharging of the second portion. In this respect, too, the volume of the first portion is preferably made slightly larger than that of the second portion. Thus, it is not actually desirable to divide the lubricant mass into two portions having substantially the same volume.

In the present method of operation of the gas vane pump, the load acting on the vane is made smaller owing to the separate discharging operations of the first and second portions of the lubricant mass which take place sequentially at the respective different times than in the known gas vane pump wherein the entire amount of the lubricant mass remaining in the lowest portion of the pump chamber is discharged at one time. This advantage according to the present invention is obtained irrespective of the volumes of the first and second portions of the lubricant mass as compared with each other. Therefore, "a condition that "a mass of a lubricant remaining in a lowest portion of the pump chamber is divided into a first portion and a second portion, by an initial divider vane which is provided by one of the plurality of vanes" depends also on the amount of the lubricant mass remaining in the lowest portion of the pump chamber when the rotor is stopped. In other words, the condition indicated above includes not only the relationship between the predetermined angular range of the rotor and the position of the initial divider vane relative to the housing, but also the amount of the lubricant mass in the lowest portion of the pump chamber.

The object indicated above may also be achieved according to a second aspect of the present invention, which provides a gas vane pump comprising: (a) a housing, (b) a rotor rotatably disposed within the housing and cooperating with the housing to define a pump chamber having a dimension in a radial direction of the rotor, which dimension varies in a rotating direction of the rotor, (c) at least one vane portion held by the rotor movably relative to the rotor and dividing the pump chamber into a plurality of variable-volume chambers, and (d) a lubricant supply passage formed through the housing and the rotor, the lubricant supply passage being closed when the rotor is placed at an angular position relative to the housing, which angular position is outside a predetermined angular range, and opened for communication with an external lubricant supply source when the rotor is placed at an angular position within the predetermined angular range, the gas vane pump being characterized in that a relative position between the lubricant supply passage in an open state thereof and an initial divider vane which is one of the at least one vane portion is determined such that a point of contact of the initial divider vane with an inner circumferential surface of the housing when the rotor is stopped at an angular position relative to the housing, which angular position is in the middle of the predetermined angular range, is located at a lowest point of the pump chamber or at a position adjacent to this lowest point.

The "lubricant supply passage in an open state thereof" described above is interpreted to mean the lubricant supply passage at the time when the cross sectional area of communication of the lubricant supply passage with the external lubricant supply source is the largest with the rotor being placed at an angular position in the middle of the predetermined angular range. As described above with respect to the method of the present invention, an amount of the lubricant mass remaining in the lowest portion of the pump chamber within the housing as a result of a flow of the lubricant through the lubricant supply passage is larger when the angular position at which the rotor is stopped is within the predetermined angular range relative to the housing than when the angular position of the rotor stopped is outside the predetermined angular range. The lubricant mass remaining in the lowest portion of the pump chamber when the rotor is stopped at an angular position within the predetermined angular range is divided by the initial divider vane into two portions, which are sequentially discharged from the housing, at respective two different times one after the other.

As described above, the method of operating a gas vane pump according to the present invention and the gas vane pump according to the present invention permit the lubricant mass remaining in the lowest portion of the pump chamber after stopping of the rotor with the lubricant supply passage being placed in its open state to be divided by the initial divider vane into two portions which are sequentially discharged from the housing one after the other. Accordingly, the loads acting on the initial divider vane and the subsequent vane are made smaller than in the case where the entire amount of the lubricant mass remaining in the pump chamber is discharged at one time. This can be achieved by simply determining the relationship between the predetermined range of the angular position of the rotor in which the lubricant supply passage is open, and the position of the initial divider vane when the rotor is stopped. Accordingly, the principle of the present invention does not require an increase in the cost of manufacture of the gas vane pump.

There will be described some modes of the present invention, by way of example, to manifest the principle of this invention. These modes of the invention include modes of the invention defined by the appended claims, and may include preferred species or forms of the claimed invention, and modes of the invention which are broader in scope than or different in inventive concept from the modes of the invention defined by the appended claims. The following modes of the invention are numbered like the appended claims, and each of those modes of the invention depends from the other mode or modes, where appropriate, for easier understanding of technical features disclosed in the present application, and possible combinations of those features. However, it is to be understood that the present invention is not limited to those technical features or combinations thereof, and that any one of a plurality of technical features described below with respect to any one mode of the invention may be a subject of the present invention, without the other technical feature or features being combined with that one feature.

It is noted that the following mode (1) is equivalent to claim 1, while the following mode (4) is equivalent to claim 7.

(1) A method of operating a gas vane pump including (a) a housing, (b) a rotor rotatably disposed within the housing and cooperating with the housing to define a pump chamber having a dimension in a radial direction of the rotor, which dimension varies in a rotating direction of the rotor, (c) at least one vane portion held by the rotor movably relative to the rotor and dividing the pump chamber into a plurality of variable-volume chambers, and (d) a lubricant supply passage formed through the housing and the rotor, the lubricant supply passage being closed when the rotor is placed at an angular position relative to the housing, which angular position is outside a predetermined angular range, and opened for communication with an external lubricant supply source when the rotor is placed at an angular position within the predetermined angular range, the method being characterized in that the vane pump is operated so as to satisfy a condition that when the rotor is stopped at an angular position relative to the housing, which angular position is within the predetermined angular range, a mass of a lubricant remaining in a lowest portion of the pump chamber is divided into a first portion and a second portion by an initial divider vane which is provided by one of the at least one vane portion.

(2) A method according to the above mode (1), characterized in that a ratio of a volume of the first portion to a volume of the second portion is within a range between 4:1 and 1:4.

The ratio indicated above is preferably between 3:1 and 1:3, more preferably between 2:1 and 1:2, and most preferably between 1.5:1 and 1:1.5.

(3) A method according to the above mode (1) or (2), characterized in that the gas vane pump is operable as a vacuum pump.

(4) A gas vane pump comprising: (a) a housing, (b) a rotor rotatably disposed within the housing and cooperating with the housing to define a pump chamber having a dimension in a radial direction of the rotor, which dimension varies in a rotating direction of the rotor, (c) at least one vane portion held by the rotor movably relative to the rotor and dividing the pump chamber into a plurality of variable-volume chambers, and (d) a lubricant supply passage formed though the housing and the rotor, the lubricant supply passage being closed when the rotor is placed at an angular position relative to the housing, which angular position is outside a predetermined angular range, and opened for communication with an external lubricant supply source when the rotor is placed at an angular position within the predetermined angular range, the gas vane pump being characterized in that a relative position between the lubricant supply passage in an open state thereof and an initial divider vane which is one of at least one vane portion is determined such that a point of contact of the initial divider vane with an inner circumferential surface of the housing when the rotor is stopped at an angular position relative to the housing, which angular position is in the middle of the predetermined angular range, is located at a lowest point of the pump chamber or at a position adjacent to this lowest point.

(5) A gas vane pump according to the above mode (4), characterized in that the position adjacent to the lowest point of the pump chamber is located within a center angle range of 30° with respect to a center of gravity of an interior space of the housing in cross section in a plane perpendicular to an axis of rotation of the rotor, the lowest point being located in the middle of the center angle range.

The center angle range is preferably 20° (±10°), more preferably 10° (±5°), and most preferably 6° (±3°), for example.

(6) A gas vane pump according to the above mode (4), characterized in that the position adjacent to the lowest point of the pump chamber is located within a predetermined center angle range with respect to a center of gravity of an interior space of the housing in cross section in a plane perpendicular to an axis of rotation of the rotor, said predetermined center angle range being no more than four times as large as the predetermined angular range of the rotor, the lowest point being located in the middle of the center angle range.

The center angle range is preferably no more than two times as large as the predetermined angular range of the rotor, and more preferably no more than the predetermined angular range of the rotor. Generally, the amount of the lubricant introduced into the housing increases with an increase in the cross sectional area of flow of the lubricant at a portion of the lubricant supply passage at which the lubricant supply passage is open to the pump chamber when the rotor is stopped. Usually, the predetermined angular range of the angular position of the rotor in which the lubricant supply passage is open increases with an increase in the maximum cross sectional area of flow of the lubricant at the above-indicated portion of the lubricant supply passage. Accordingly, the amount of the lubricant introduced into the housing increases with an increase in the predetermined angular range of the rotor. Where the amount of the lubricant introduced into the housing is relatively large, the lubricant mass in the housing is divided by the initial divider vane into two portions even if "the position adjacent to the lowest point" is selected within a relatively large center angle range with respect to the center line of the housing. For this reason, it is reasonable to determine the center angle range of "the position adjacent to the lowest point", on the basis of the predetermined angular range in which the lubricant supply passage is open.

BEST MODE FOR CARRYING OUT THE INVENTION

Referring to the accompanying drawings, there will be described one embodiment of this invention. However, it is to be understood that the present invention may be embodied, with various changes and modifications which may occur to those skilled in the art, as described above with respect to the preferred forms of the invention.

Figure 1:
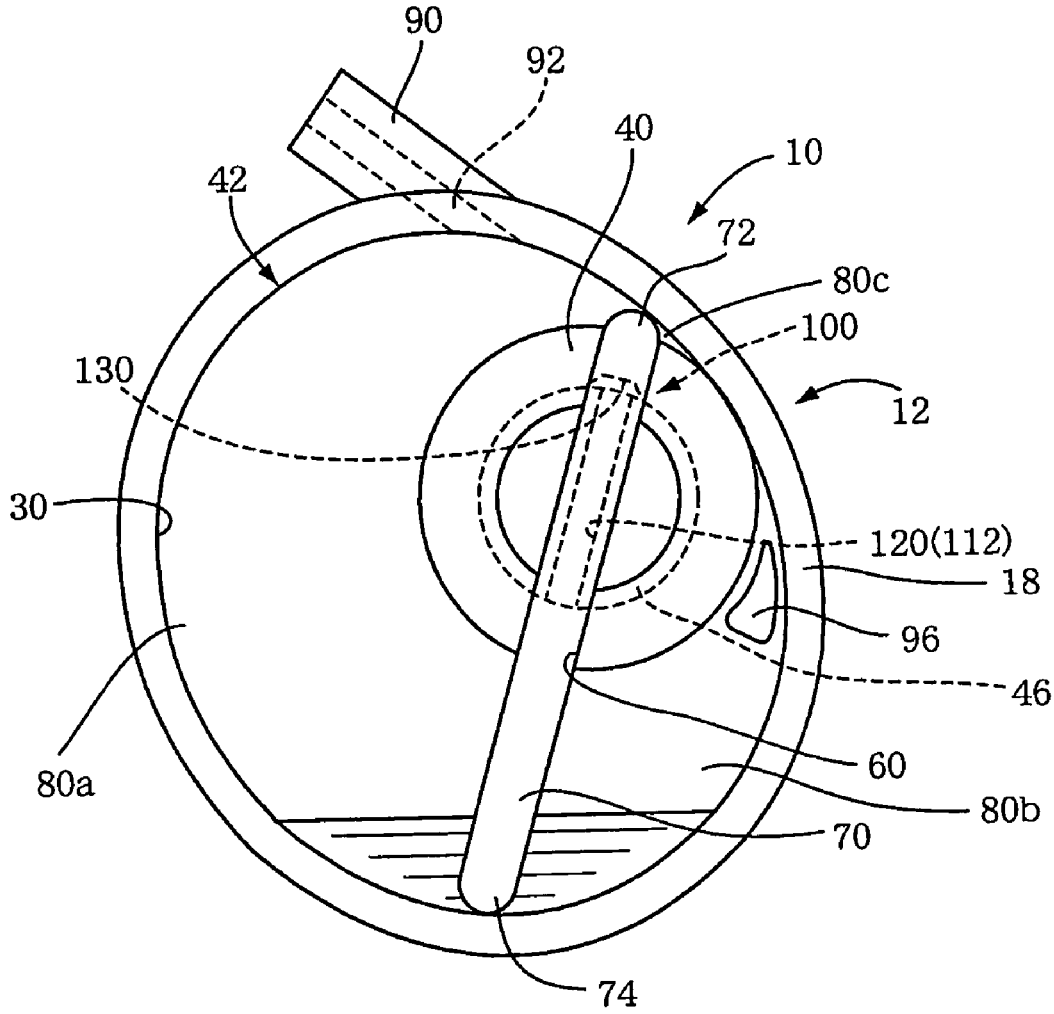
FIG. 1 is a front elevational view showing a vane pump constructed according to one embodiment of the present invention, in one operating state of the vane pump with its covering portion being removed.
Figure 2:
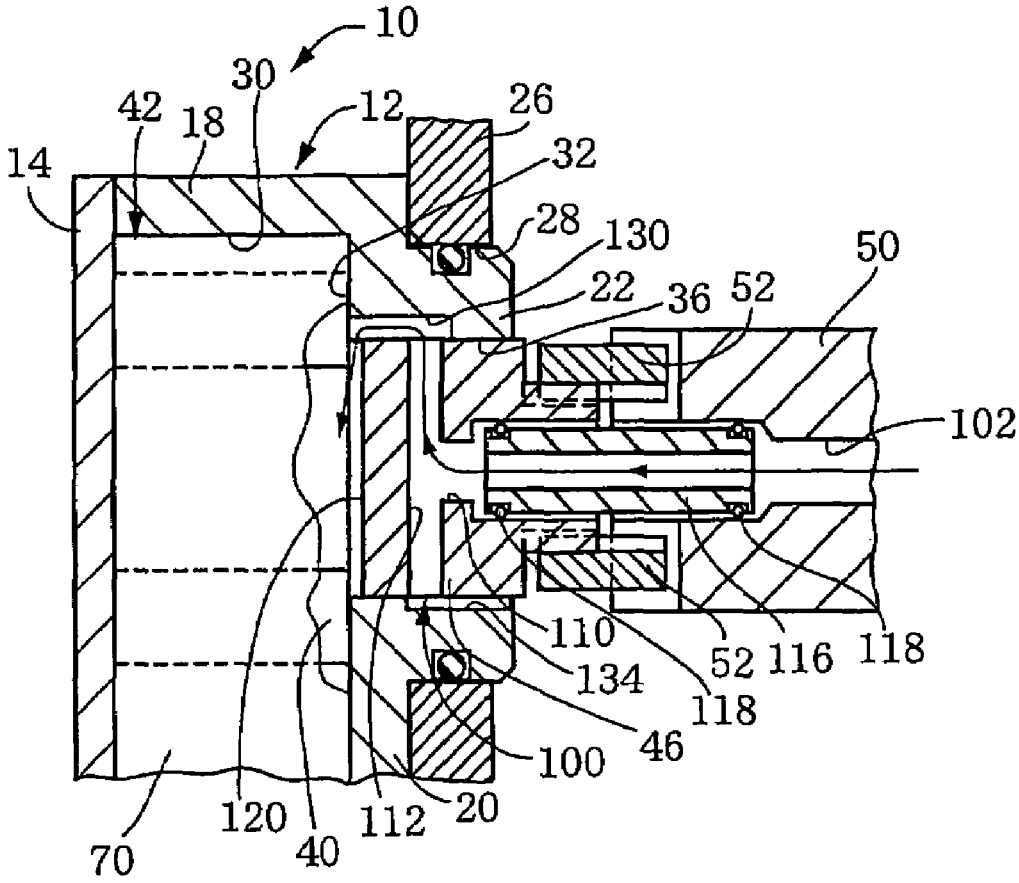
FIG. 2 is a side elevational view in axial cross section of the vane pump of FIG. 1.

A gas vane pump constructed according to one embodiment of this invention is shown in FIG. 1 through FIG. 4. This vane pump is used as a vacuum pump for a brake booster arranged for use on a motor vehicle. The vane pump has a housing 10, which includes a main body portion 12 having opposite open and closed axial ends, and a covering portion 14 which closes the open axial end of the main body portion 12. The main body portion 12 includes a circumferential wall portion 18, an end wall portion 20 and a bearing portion 22, which are formed integrally with each other in the present embodiment of the vane pump. The end wall portion 20 constitutes the above-indicated closed axial end of the main body portion 12 opposite to the open end closed by the covering portion 14. The bearing portion 22 extends from the end wall portion 20 in an axial direction away from the circumferential wall portion 18. The housing 10 is fixed to an engine casing 26, as shown in FIG. 2. The engine casing 26 includes a wall portion having a fitting hole 28 in which the bearing portion 22 can be fitted. The housing 10 is fixed to the engine casing 26, with the bearing portion 22 fitted in the fitting hole 28 such that an end face of the engine casing 26 in which the fitting hole 28 is open is held in abutting contact with an annular outer end face of the end wall portion 20. With the main body portion 12 being thus positioned relative to the engine casing 26, the housing 10 is fixed to the engine casing 26, with screws or any other suitable fastening means. The main body portion 12 has an accommodating space 30 for accommodating a vane and a rotor (which will be described), and a shaft hole 36 formed so as to extend in its axial direction and open in an inner end face 32 of the end wall portion 20, which defines one axial end of the accommodating space 30. The shaft hole 36 has a diameter smaller than that of the accommodating space 30. The shaft hole 36 has a circular shape in transverse cross section of the main body portion 12, and is eccentric with respect to the accommodating space 30. In the present application, the inner circumferential surface of the accommodating space 30 may be referred to as "an inner circumferential surface of the housing 10" or "an inner circumferential surface of pump chamber or chambers".

Within the housing 10, there is rotatably accommodated a rotor 40. In the present vane pump, the rotor 40 has an axis of rotation which extends in the horizontal direction and which is eccentric with respect to the circumferential wall portion 18. In the present embodiment, the rotor 40 is held in substantial point contact at its outer circumferential surface with the inner circumferential surface of the circumferential wall portion 18 of the main body portion 12 of the housing 10. Namely, the outer circumferential surface of the rotor 40 is inscribed with respect to the inner circumferential surface of the circumferential wall portion 18. Further, the rotor 40 is held in contact or close proximity at its opposite end faces with the inner surface of the covering portion 14 and the inner end surface 32 of the end wall portion 20 (which defines the axial end of the accommodating space 30 remote from the covering portion 14). In this arrangement, the housing 10 (main body portion 12 and covering portion 14) and the rotor 40 cooperate with each other to define a pump chamber 42 whose dimension in the radial direction of the rotor 40 varies in the circumferential direction of the circumferential wall portion 18, that is, in the rotating direction of the rotor 40. The rotor 40 includes a shaft portion 46, which is rotatably fitted in and axially extends through the shaft hole 36, for mechanical coupling with a drive source (which will be described). The shaft portion 36 may be initially manufactured as a member separate from a main body portion of the rotor 40 and subsequently welded (friction-welded), brazed or otherwise fixed to the main body portion, or may alternatively be formed integrally with the main body portion. In either of these cases, the shaft portion 46 functions as a part of the rotor 40. The shaft portion 46 is connected, at its axial end portion remote from the main body portion of the rotor 40, to one end portion of a cam shaft 50 of an engine of the motor vehicle, through a rotation-transmitting device in the form of a coupling 52. The cam shaft 40 functions as a rotor drive shaft operable to rotate the rotor 40. The coupling 52 mechanically connects the cam shaft 50 and the shaft portion 46 to each other, so as to permit a relatively small distance of relative axial movement therebetween.

The rotor 40 has a vane slot 60 formed therethrough in one diametric direction, so as to pass its center (axis of rotation). A vane 70 is held by the rotor 40 such that the vane 70 is movable in its longitudinal direction, in sliding contact with the opposite inner surfaces of the vane slot 60. The inner surface of the covering portion 14 and the bottom surface of the vane slot 60 formed in the rotor 40 substantially prevent a movement of the vane 70 relative to the rotor 40 in the axial direction of the rotor 40. The dimension of the vane 70 in its longitudinal direction (in the diametric direction of the rotor 40) is larger than the dimension of the vane slot 60 in the diametric direction of the rotor 40, so that opposite longitudinal end portions 72, 74 of the vane 70 can protrude from the outer circumferential surface of the main body portion of the rotor 40 such that those end portions 72, 74 are held in contact or close proximity with the inner circumferential surface of the circumferential wall portion 18 of the housing 10. In this respect, the single vane 70 may be considered to consist of two vane portions that are formed integrally with each other. The vane 70 and the rotor 40 divides the above-indicated pump chamber 42 within the housing 10, into a plurality of variable-volume chambers 80. Namely, the housing 10, rotor 40 and vane 70 define three variable-volume chambers 80 in almost all angular phases of the vane pump, as indicated in FIGS. 1 and 4, and two variable-volume chambers 80 in only one angular phase of the vane pump, that is, at an angular position of the rotor 40 relative to the circumferential wall portion 18, which angular position is within a predetermined angular range, as indicated in FIG. 3.

Figure 3:
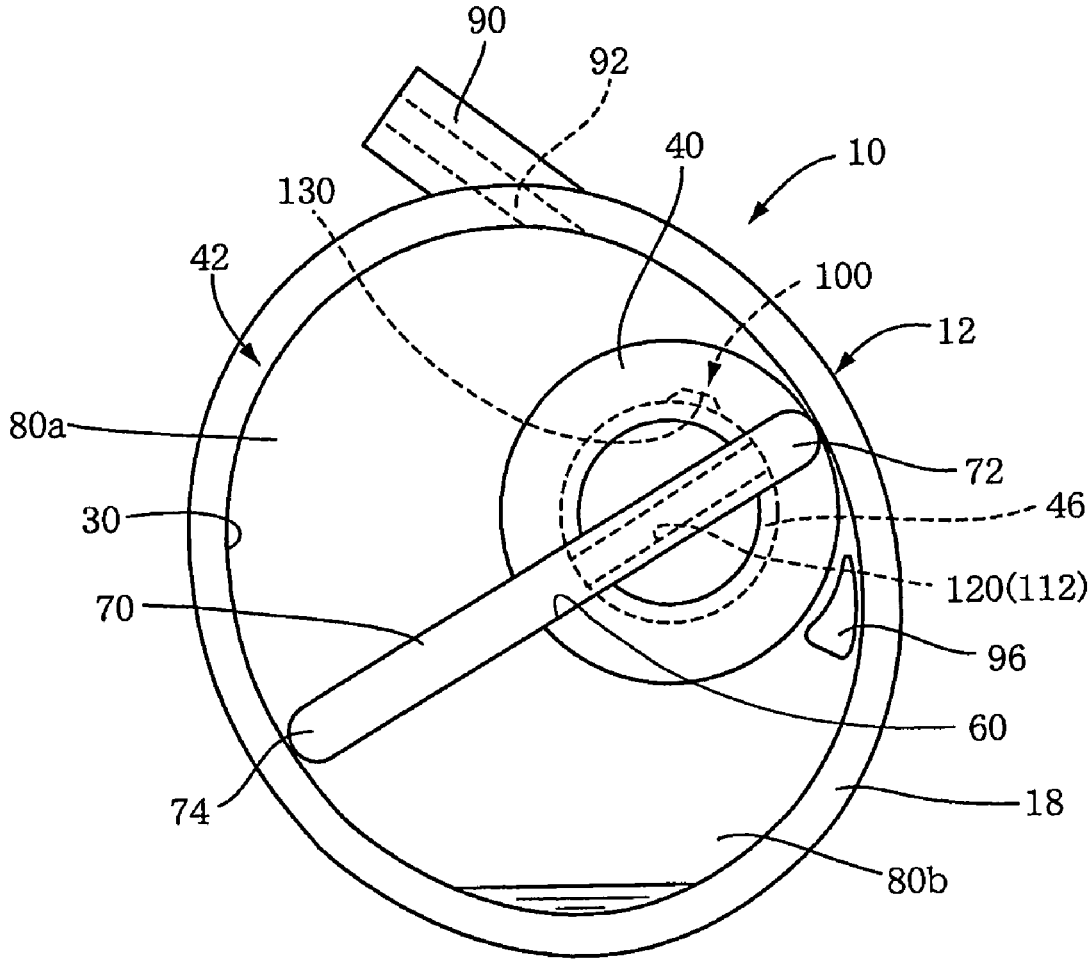
FIG. 3 is a front elevational view showing the vane pump of FIG. 1 in another operating state with its covering portion being removed.
Figure 4:
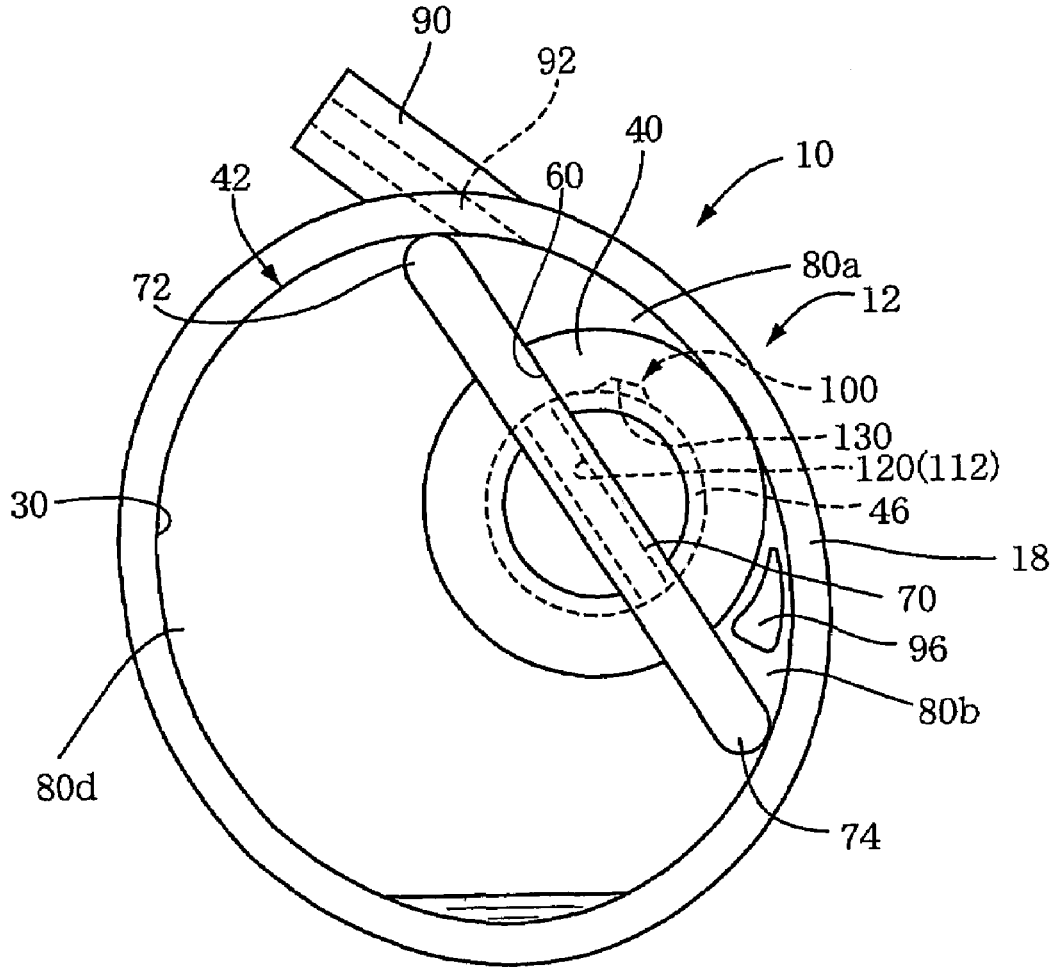
FIG. 4 is a front elevational view showing the vane pump of FIG. 1 in a still another operating state with its covering portion being removed.

As shown in FIGS. 1, 3 and 4, the variable-volume chambers 80 include a suction chamber 80*a* in which a suction passage formed through a suction tube 90 integrally formed with the housing 10 is open at its inner end serving as a suction portion 92. The suction passage of the suction tube 90 is held in communication with the vacuum booster or a vacuum tank (not shown). As shown in FIG. 1, the suction chamber 80*a* takes one of three different forms. In the first form, the opposite ends of the suction chamber 80*a* as seen in the circumferential direction of the body portion 12 of the housing 10 are defined by the opposite end portions 72, 74 of the vane 70, as shown in FIG. 1. In the second form, one of the opposite ends of the suction chamber 80*a* is defined by the point of contact of the rotor 40 with the inner circumferential surface of the rotor 40, while the other end of the suction chamber 80*a* is defined by the end portion 72 of the vane 70, as shown in FIG. 4. In the third form, one of the opposite ends of the suction chamber 80*a* is defined by both the end portion 72 of the vane 70 and the point of contact of the rotor 40 with the inner circumferential surface of the circumferential wall portion 18, while the other end of the suction chamber 80*a* is defined by the other end portion 74 of the vane 70, as shown in FIG. 3. In the first and second forms, the pump chamber 42 is divided into the three pump chambers 80*a*, 80*b* and 80*c* (80*d*) including the suction chamber 80*a*. In the third form, the pump chamber 42 is divided into the two pump chambers 80*a*, 80*b* including the suction chamber 80*a*. The pump chamber 42 further include a discharge chamber 80*b* in which a discharge port 96 of a discharge passage is open.

The internal volume of each of the variable-volume chambers 80 varies as the vane 70 is rotated with the rotor 40, so that a gas is sucked into the suction chamber 80*a* while the gas is discharged from the discharge chamber 80*b*. Described in detail, the cam shaft 50 is rotated to rotate the rotor 40, for rotating the vane 70 within the pump chamber 42 such that the opposite end portions 72, 74 of the vane 70 are held in sliding contact with the inner circumferential surface of the circumferential wall portion 18 of the housing 10. As a result, the volume of the suction chamber 80 is gradually increased, and the pressure within this suction chamber 80*a* is gradually lowered, that is, the suction chamber 80*a* is evacuated, with the gas (usually, air) being sucked into the suction chamber 80 through the suction port 92, so that a negative-pressure chamber of the vacuum booster communicating with the suction port 92 or the vacuum tank communicating with the negative-pressure chamber is evacuated. In the meantime, the internal volume of the discharge chamber 80*b* is gradually decreased, so that the gas is discharged out of the housing 10, through the discharge port 96 communicating with the discharge chamber 80*b*.

The present vane pump is a kind of gas vane pump of an intermittent lubrication type wherein a lubricant is intermittently introduced into the housing 10 during rotation of the rotor 40. Namely, the present vane pump has a lubricant supply passage 100 formed through the housing 10 and the rotor 40, so that the lubricant is intermittently supplied from the engine of the motor vehicle into the pump chamber 42 through the lubricant supply passage 100, for lubricating the inner surfaces of the housing 10, and the rotor 40 and the vane 70. As shown in FIG. 2, the cam shaft 50 has a center hole 102 formed through its radially central part so as to extend in its axial direction and to be open in its end face on the side of the rotor 40. On the other hand, the shaft portion 46 of the rotor 40 has an axial hole 110 formed through its radially central part so as to extend in its axial direction and to be open in its distal end face on the side of the cam shaft 50. The shaft portion 46 further has a diametric hole 112 communicating with one axial end portion of the axial hole 110, which is remote from the above-indicated distal end face. The diametric hole 112 is formed in one diametric direction of the shaft portion 46 such that the diametric hole 112 is open in the circumferential surface of the shaft portion 46, at its two diametrically opposite circumferential positions. This diametric hole 112 may be considered to be two radial holes formed along one straight line. The center hole 102 of the cam shaft 50 and the axial hole 110 of the shaft portion 46 are held in communication with each other through a communication tube 116 having an inner passage. Two sealing members 118 are disposed between the respective opposite end portions of the outer circumferential surface of the communication tube 116 and the corresponding end portions of the center hole 102 and the axial hole 110. The sealing members 118 prevent leakage of the lubricant from the connections between the communication tube 116 and the holes 102, 110. The diametric direction of the shaft portion 46 in which the diametric hole 112 extends is parallel to the diametric direction in which the vane slot 60 extends. The shaft portion 46 further has a diametric passage 120 formed in a diametric direction parallel to the diametric direction in which the vane slot 60 extends through the rotor 40. The diametric passage 120 is defined by a groove which is formed in parallel and in communication with the vane slot 60 and which has a smaller width dimension than the vane slot 60 as seen in the direction of thickness of the vane 70. The groove indicated above is closed by one of the opposite side faces of the vane 70 which is on the side of the shaft portion 46, whereby the diametric passage 120 is formed. The diametric passage 120 may be replaced by one radial passage which is open in the circumferential surface of the shaft portion 46, at only one circumferential position thereof.

The main body portion 12 of the housing 10 has a communication groove 130 formed in the inner circumferential surface defining the shaft hole 36. This communication groove 130 is open at one of its opposite ends to the accommodating space 30 (namely, open in the inner end face 32 of the end wall portion 20), but is not open in the outer end face of the bearing portion 22. The communication groove 130 has a length in the axial direction of the shaft portion 46 of the rotor 40, which is larger than a length of the proximal end portion of the shaft portion 46 in which the diametric hole 112 and the diametric passage 120 are formed. When the rotor 40 is placed within the predetermined range of angular position relative to the circumferential wall portion 18 of the housing 10, as described below in detail, the communication groove 130 is communicated with one of opposite ends of the diametric hole 112 and one of opposite ends of the diametric passage 120. The main body portion 12 further has a ventilation groove 134 formed in the inner circumferential surface defining the shaft hole 36, at a circumferential position diametrically opposite to the circumferential position of the communication groove 130. This ventilation groove 134 is open at one of its opposite ends in the outer end face of the bearing portion 22 (namely, open to the atmosphere), but is not open to the accommodating space 30. The ventilation groove 134 has a length determined such that when the rotor 40 is placed at an angular position within the predetermined angular range relative to the circumferential wall portion 18 of the housing 10, the ventilation groove 134 is communicated with the other end of the diametric hole 112 but is not communicated with the other end of the diametric passage 120. Within the predetermined range of angular position of the rotor 40 relative to the circumferential wall portion 18 of the housing 10, the diametric hole 112 is held in communication at its one end (at its upper end as seen in FIG. 2) with the communication groove 130, while the diametric passage 120 is also held in communication at its one end (at its upper end) with the communication groove 130. In the present embodiment, the lubricant supply passage 100 indicated above is defined by the passage formed through the communication tube 116, the axial hole 110, the diametric hole 112, the diametric passage 120 and the communication groove 130. When the rotor 40 is placed at an angular position outside the predetermined angular range indicated above, as indicated in FIGS. 3 and 4 by way of example, the lubricant supply passage 100 is closed. When the rotor 40 is within the predetermined range of angular position indicated in FIG. 1, on the other hand, the lubricant supply passage 100 is open, so that the interior of the housing 10 is lubricated with the lubricant supplied from a lubricant supply source provided in the engine. In this open state of the lubricant supply passage 100, the pressurized lubricant delivered from the engine is fed through the lubricant supply passage 100 to the rotor 40 and the vane 70, in particular, the surfaces of sliding contact between the vane 70 and the vane slot 60 of the rotor 40, and the surfaces of sliding contact between the vane 70 and the housing 10. It is noted that the center hole 102 may be considered to be a part of the lubricant supply passage 100. When the rotor 40 is placed at an angular position within the predetermined angular range relative to the circumferential wall portion 18, the diametric hole 112 is communicated at its other end with the ventilation groove 134. However, the rate of flow of the lubricant from the ventilation groove 134 back to the engine is comparatively low since the depth of the ventilation groove 134 is considerably smaller than the depth of the communication passage 130.

The intermittent supply of the lubricant from the engine to the interior of the housing 100 during rotation of the rotor 40 is terminated when the engine and the present vane pump are turned off or stopped. If the rotor 40 is stopped such that its angular position is within the predetermined angular range indicated above, the lubricant is introduced into the pump chamber 42 through the lubricant supply passage 100 placed in its open state, owing to a negative or reduced pressure within the pump chamber 42. In this case, a certain amount of the lubricant is accommodated in the lower part of the pump chamber 42. Since the ventilation groove 134 is held in communication with the lubricant supply passage 100, air is also drawn into the pump chamber 42, so that the amount of introduction of the lubricant into the pump chamber 42 is reduced by an amount of drawing of the air into the pump chamber 42 through the ventilation groove 134. The amount of introduction of the lubricant into the pump chamber 42 can be adjusted by adjusting the ratio of the cross sectional areas of flow of the lubricant of the lubricant supply passage 100 and the ventilation groove 134.

The relative position in the rotating direction of the rotor 40 between the rotor 40 having the diametric hole 112 and the diametric passage 120 and the vane 70, and the relative position in the rotating direction of the rotor 40 between the rotor 40 and the housing 10 having the communication groove 130 are determined as described above. Namely, those relative positions are determined such that when the rotor 40 is placed in the middle of the predetermined range of angular position relative to the circumferential wall portion 18, as shown in FIG. 1, the point of contact of the end portion 74 of the vane 70 with the inner circumferential surface of the circumferential wall portion 18 is located at the lowest position of that inner circumferential surface, that is, at the lowest point of the pump chamber 42. In the relative angular position of the rotor 40 of FIG. 1, therefore, a mass of the lubricant remaining in the lowest portion of the interior space of the housing 10 (in the lowest portion of the pump chamber 42) is divided by the end portion 74 of the vane 70 into two substantially equal portions. When the rotor 40 is stopped such that the angular position of the rotor 40 relative to the housing 10 is within the predetermined angular range, the mass of the lubricant remaining in the lowest portion of the interior space of the housing 10 is divided by the end portion 74 into a first portion and a second portion. In the present embodiment, one of two sections of the vane 70 which includes the end portion 74 functions as an initial divider vane, which divides a mass of the lubricant remaining in the lowest portion of the pump chamber 42 into a first portion and a second portion, when the rotor 40 is stopped at an angular position relative to the housing 10, which is within a predetermined range. When the operation of the present vane pump is resumed while the lubricant mass in the housing 10 is divided into the first and second portions, the first portion of the lubricant mass on the upstream or leading side of the initial divider vane (including the end portion 74) as seen in the rotating direction of the rotor 40 is discharged through the discharge port 96, by the initial divider vane. Subsequently, the second portion of the lubricant mass on the downstream or trailing side of the initial divider vane is discharged through the discharge port 96, by a subsequent vane which is the other of the above-indicated two sections of the vane 70, which includes the other end portion 72.

When the rotor 40 is stopped at an angular position within the predetermined range in which the lubricant supply passage 100 is open, the lubricant is introduced into the housing 10 owing to the negative pressure within the housing 10, and the mass of the introduced lubricant is divided by the vane 70 into the two portions. Therefore, when the rotation of the rotor 40 is resumed, the two portions of the lubricant mass are discharged at respective two different times one after the other, so that the vane 70 is protected from an excessive load due to the lubricant mass remaining within the housing 10 upon subsequent starting of the vane pump. Accordingly, the operating noise of the vane pump is reduced, and the durability of the vane pump is improved. Yet, the present vane pump does not require a lubricant metering device, and is accordingly available at a comparatively low cost. When the rotor 40 is stopped at an angular position outside the predetermined range, the lubricant mass in the lowest portion of the pump chamber 42 is not divided by the initial divider vane. In this case, however, the lubricant supply passage 100 is closed, so that the amount of introduction of the lubricant into the housing 10 is small, making it possible to restart the vane pump without an excessive load acting on the vane 70.

In the illustrated embodiment which has been described, the rotary motion of the cam shaft 50 is transmitted to the rotor 40 through the coupling 52. However, the coupling 52 may be replaced by gears, a belt, or any other suitable rotation transmitting means. Although the vane pump according to the illustrated embodiment is arranged such that the lubricant is initially supplied to the shaft portion 46 of the rotor 40, the vane pump may be modified such that the lubricant is initially supplied to the housing 10, and is then intermittently supplied to the rotor 40.

While the vane pump according to the illustrated embodiment uses only one vane 70 slidably movably supported by the rotor 40, the principle of the present invention is equally applicable to vane pumps of various other types, such as a vane pump of a type in which two vanes are slidably movably held by a single vane slot formed in the rotor, as disclosed in JP-3-115792A, and a vane pump of a type in which a plurality of vanes (e.g., three vanes) are slidably movably held by respective vane slots formed in the rotor.

The invention claimed is:

1. A method of operating a gas vane pump including:

a housing, a rotor rotatably disposed within said housing and cooperating with said housing to define a pump chamber having a dimension in a radial direction of the rotor, which dimension varies in a rotating direction of the rotor, at least one vane portion held by said rotor movably relative to said rotor and dividing said pump chamber into a plurality of variable-volume chambers, and a lubricant supply passage formed through said housing and said rotor, said lubricant supply passage being closed when said rotor is placed at an angular position relative to said housing which angular position is outside a predetermined angular range, and opened for communication with an external lubricant supply source when said rotor is placed at an angular position within said predetermined angular range, wherein said vane pump is operated so as to satisfy a condition that when said rotor is stopped at an angular position relative to said housing, which angular position is within said predetermined angular range, a mass of a lubricant remaining in a lowest portion of said pump chamber is divided into a first portion and a second portion, by an initial divider vane which is provided by one of said at least one vane portion.

2. A method according to claim 1, wherein a ratio of a volume of said first portion to a volume of said second portion is within a range between 4:1 and 1:4.

3. A method according to claim 2, wherein said ratio is between 3:1 and 1:3.

4. A method according to claim 2, wherein said ratio is between 2:1 and 1:2.

5. A method according to claim 2, wherein said ratio is between 1.5:1 and 1:1.5.

6. A method according to claim 1, wherein said gas vane pump is operable as a vacuum pump.

7. A gas vane pump comprising:

a housing;

a rotor rotatably disposed within said housing and cooperating with said housing to define a pump chamber having a dimension in a radial direction of the rotor, which dimension varies in a rotating direction of the rotor;

at least one vane portion held by said rotor movably relative to said rotor and dividing said pump chamber into a plurality of variable-volume chambers; and a lubricant supply passage formed through said housing and said rotor, said lubricant supply passage being closed when said rotor is placed at an angular position relative to said housing, which angular position is outside a predetermined angular range, and opened for communication with an external lubricant supply source when said rotor is placed at an angular position within said predetermined angular range, wherein a relative position between said lubricant supply passage in an open state thereof and an initial divider vane which is one of said at least one vane portion is determined such that a point of contact of said initial divider vane with an inner circumferential surface of said housing when said rotor is stopped at an angular position relative to said housing, which angular position is in the middle of said predetermined angular range, is located at a lowest point of said pump chamber or at a position adjacent to said lowest point.

8. A gas vane pump according to claim 7, wherein the position adjacent to said lowest point of said pump chamber is located within a center angle range of 30° with respect to a center of gravity of an interior space of said housing in cross section in a plane perpendicular to an axis of rotation of said rotor, said lowest point being located in the middle of said center angle range.

9. A gas vane pump according to claim 8, wherein said center angle range is 20°.

10. A gas vane pump according to claim 8, wherein said center angle range is 10°.

11. A gas vane pump according to claim 8, wherein said center angle range is 6°.

12. A gas vane pump according to claim 7, wherein said position adjacent to said lowest point of said pump chamber is located within a predetermined center angle range with respect to a center of gravity of an interior space of said housing in cross section in a plane perpendicular to an axis of rotation of said rotor, said predetermined center angle range being no more than four times as large as said predetermined angular range of said rotor, said lowest point being located in the middle of said center angle range.

13. A gas vane pump according to claim 12, wherein said center angle range is no more than two times as large as said predetermined angular range of said rotor.

14. A gas vane pump according to claim 12, wherein said center angle range is no more than said predetermined angular range of said rotor.

15. A method of operating a gas vane pump including:

a housing, a rotor rotatably disposed within said housing and cooperating with said housing to define a pump chamber having a dimension in a radial direction of the rotor, which dimension varies in a rotating direction of the rotor, at least one vane portion held by said rotor movably relative to said rotor and dividing said pump chamber into a plurality of variable-volume chambers, and a lubricant supply passage for introducing a lubricant from an external lubricant supply source into said pump chamber, wherein said rotor is stopped at an angular position relative to said housing, at which a mass of a lubricant remaining in a lowest portion of said pump chamber is divided into a first portion and a second portion, by an initial divider vane which is provided by one of said at least one vane portion, and that when rotation of said rotor is resumed, said first portion is first discharged from said pump chamber by said initial divider vane, and said second portion is then discharged from said pump chamber by a subsequent vane which follows said initial divider vane.

16. A method according to claim 15, wherein said lubricant supply passage is formed through said housing and said rotor, and is closed when said rotor is placed at an angular position relative to said housing, which angular position is outside a predetermined angular range, and opened for communication with said external lubricant supply source when said rotor is placed at an angular position within said predetermined angular range, said vane pump being operated so as to satisfy a condition that when said rotor is stopped at the angular position within said predetermined angular range, said mass of the lubricant remaining in said lowest portion of said pump chamber is divided into said first and second portions by said initial divider vane.

* * * * *